US009286907B2

(12) United States Patent
Yang et al.

(10) Patent No.: US 9,286,907 B2
(45) Date of Patent: Mar. 15, 2016

(54) SMART REJECTER FOR KEYBOARD CLICK NOISE

(71) Applicant: Creative Technology Ltd, Singapore (SG)

(72) Inventors: Jun Yang, San Jose, CA (US); Klaas Carlo Vogelsang, Fremont, CA (US); Ian Kenneth Minett, San Jose, CA (US); Robert Jan Ridder, Santa Cruz, CA (US); Steven Burritt Verity, Santa Clara, CA (US)

(73) Assignee: Creative Technology Ltd, Singapore (SG)

( * ) Notice: Subject to any disclaimer, the term of this patent is extended or adjusted under 35 U.S.C. 154(b) by 428 days.

(21) Appl. No.: 13/683,777

(22) Filed: Nov. 21, 2012

(65) Prior Publication Data

US 2013/0132076 A1 May 23, 2013

Related U.S. Application Data

(60) Provisional application No. 61/563,531, filed on Nov. 23, 2011.

(51) Int. Cl.

| | |
|---|---|
| ***G10L 19/00*** | (2013.01) |
| ***G10L 21/0208*** | (2013.01) |
| ***G10L 21/0216*** | (2013.01) |
| ***G10L 25/78*** | (2013.01) |
| ***G10L 25/18*** | (2013.01) |
| ***G10L 25/21*** | (2013.01) |
| ***G10L 25/09*** | (2013.01) |
| ***G10L 25/12*** | (2013.01) |

(52) U.S. Cl.

CPC ..... *G10L 21/0208* (2013.01); *G10L 21/0216* (2013.01); *G10L 25/09* (2013.01); *G10L 25/12* (2013.01); *G10L 25/18* (2013.01); *G10L 25/21* (2013.01); *G10L 25/78* (2013.01)

(58) Field of Classification Search

CPC . G10L 21/0208; G10L 21/0272; G10L 25/78; G10L 25/90; G10L 25/93; G01N 29/348; G01N 29/38

USPC ..... 704/219, 9, 270, 254, 246, 233, 226, 704/214, 211, 206, 202, 200.1; 702/187; 382/262; 381/94.4, 94.3, 94.1, 92, 381/71.1, 56; 379/93.08, 392.01; 375/227; 370/412; 367/124

See application file for complete search history.

(56) References Cited

U.S. PATENT DOCUMENTS 4,658,426 A * 4/1987 Chabries ..... G10L 21/0208 381/71.11
4,924,492 A * 5/1990 Gitlin ..... H04L 27/3438 370/286

(Continued)

*Primary Examiner* — Michael Colucci
(74) *Attorney, Agent, or Firm* — Russell Swerdon; Desmund Gean

(57) ABSTRACT

According to various embodiments of the invention, a new and effective keyboard click noise reduction scheme is presented. The keyboard click noise reduction scheme may have various processing units including: Dynamic Signal Modeler, Smart Model Selector, Adaptive Filtering Module, Keyboard/Impulse Noise and Voice Activity Detectors, and a Post-Processing Unit. By adaptively changing the coefficients of the proposed adaptive filter through minimizing the output energy, the scheme can provide the target signal/voice with nearly zero keyboard click noise. The scheme could be used in real-time to minimize keyboard click noise or any kind of unwanted noise, especially noise having transient impulse characteristics.

22 Claims, 7 Drawing Sheets

(56) References Cited

U.S. PATENT DOCUMENTS 5,825,898 A 10/1998 Marash
6,049,607 A 4/2000 Marash et al.
6,205,422 B1 * 3/2001 Gu ..... G10L 25/78 704/210
6,249,757 B1 * 6/2001 Cason ..... G10L 25/78 370/289
6,363,345 B1 3/2002 Marash et al.
6,377,637 B1 4/2002 Berdugo
6,483,923 B1 11/2002 Marash
6,615,170 B1 * 9/2003 Liu ..... G10L 25/78 704/231
6,728,661 B1 * 4/2004 Cannelli ..... G01N 29/348 702/187
7,243,065 B2 * 7/2007 Stephens ..... G10L 19/012 704/216
7,411,865 B2 * 8/2008 Calhoun ..... G01S 7/003 367/124
7,546,236 B2 * 6/2009 Stentiford ..... 704/201
7,610,196 B2 * 10/2009 Nongpiur ..... G10L 21/0364 704/206
8,041,026 B1 * 10/2011 Coughlan ..... G10L 21/0208 379/392.01
2003/0099287 A1 * 5/2003 Arambepola ..... H03G 3/345 375/227
2005/0075866 A1 * 4/2005 Widrow ..... G10L 21/0208 704/211
2005/0086058 A1 * 4/2005 Lemelson ..... H04R 5/04 704/270
2005/0143976 A1 * 6/2005 Steniford ..... G10L 25/69 704/202
2007/0177620 A1 * 8/2007 Ohmuro ..... G10L 19/005 370/412
2008/0270131 A1 * 10/2008 Fukuda ..... G10L 21/0272 704/246
2009/0034752 A1 * 2/2009 Zhang ..... H04R 3/005 381/92
2009/0285410 A1 * 11/2009 Garcia ..... G10L 21/0208 381/94.1
2010/0030556 A1 * 2/2010 Tanaka ..... G10L 21/0208 704/226
2010/0100382 A1 * 4/2010 Rao ..... G10L 25/78 704/254
2010/0246992 A1 * 9/2010 Kempf ..... H04N 7/0137 382/262
2010/0329320 A1 * 12/2010 Umehara ..... G06N 7/02 375/227
2011/0026722 A1 * 2/2011 Jing ..... G10L 21/0208 381/71.1
2011/0033055 A1 * 2/2011 Low ..... G10L 21/0208 381/56
2011/0103615 A1 * 5/2011 Sun ..... G10L 21/0208 381/94.3
2011/0112831 A1 * 5/2011 Sorensen ..... G10L 21/0208 704/226
2011/0142257 A1 * 6/2011 Goodwin ..... G10L 19/005 381/94.4
2011/0153313 A1 * 6/2011 Etter ..... G10L 25/69 704/200.1
2013/0073279 A1 * 3/2013 Mills ..... G06F 17/2229 704/9

* cited by examiner

SMART REJECTER FOR KEYBOARD CLICK NOISE

BACKGROUND OF THE INVENTION

1. Field of the Invention

The present invention relates to processing signals. More particularly, the present invention relates to a device and method for processing communication signals.

2. Description of the Related Art

Unwanted noise is a problem in any communication. On Skype, for instance, communication between parties is often facilitated by concurrently typing messages with a keyboard and speaking through a microphone. Keyboard click noise is often picked up by the microphone and transmitted over to one's headphones or speakers. The noise usually intermixes with the voice and interferes with one's ability to decipher the voice message. The noise often makes the voice message unintelligible or indistinct. As such, keyboard click noise can be very annoying in any voice communication and it is highly desirable to remove this noise or at least to significantly minimize its level.

Unfortunately, it is a very challenging task to minimize the keyboard click noise since keyboard click noise is completely different from other noise sources. Conventional noise reduction schemes have not been successful. One conventional noise reduction scheme implements a band-stop filtering technique. But, this technique presents two problems: (1) cancellation of voice if it is at the same signal band as the keyboard click noise; and (2) output will include audible artifacts (sometimes, the artifacts level could be the same as that of the keyboard click noise level itself). These two problems highly prevent this technology and its products from being widely accepted by customers and from being practically used.

Accordingly, goals of the present invention include addressing the above problems by providing an effective keyboard click noise minimization scheme and its real-time implementation.

SUMMARY OF THE INVENTION

In one aspect of the invention, a method for an impulse noise filter to minimize impulse noise in a communication session is provided. The method includes 1) receiving an audio input from an audio source; 2) determining whether the audio input includes impulse noise; 3) determining whether the audio input includes voice; and 4) generating an audio output by adaptively filtering the audio input based on the determination of impulse noise being included in the audio input and based on the determination of voice being included in the audio input. The adaptive filtering minimizes the impulse noise and maximizes the voice in the audio input.

In another aspect of the invention, an impulse noise filter for minimizing impulse noise in a communication session is provided. The impulse noise filter includes an input interface, an impulse noise determination module, a voice activity determination module, and an adaptive filtering module. The input interface is operable to receive an audio input from an audio source. The impulse noise determination module is operable to determine whether the audio input includes impulse noise. The voice activity determination module is operable to determine whether the audio input includes voice. The adaptive filtering module is operable to generate an audio output by adaptively filtering the audio input based on the determination of impulse noise being included in the audio input and based on the determination of voice being included in the audio input. The adaptive filtering minimizes the impulse noise and maximizes the voice in the audio input.

The invention extends to a machine readable medium embodying a sequence of instructions that, when executed by a machine, cause the machine to carry out any of the methods described herein.

Some of the advantages of the present invention include: 1) substantially no cancellation of the targeted signal/voice; 2) substantially no artifacts in the output; 3) real-time implementation; 4) robust processing of and adaptability to various input signals (e.g., impulse noise, voice, ambient noise, or any combination of these); 5) smart filtering of unwanted noise. These and other features and advantages of the present invention are described below with reference to the drawings.

DETAILED DESCRIPTION OF PREFERRED EMBODIMENTS

Reference will now be made in detail to preferred embodiments of the invention. Examples of the preferred embodiments are illustrated in the accompanying drawings. While the invention will be described in conjunction with these preferred embodiments, it will be understood that it is not intended to limit the invention to such preferred embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well known mechanisms have not been described in detail in order not to unnecessarily obscure the present invention.

It should be noted herein that throughout the various drawings like numerals refer to like parts. The various drawings illustrated and described herein are used to illustrate various features of the invention. To the extent that a particular feature is illustrated in one drawing and not another, except where otherwise indicated or where the structure inherently prohibits incorporation of the feature, it is to be understood that those features may be adapted to be included in the embodiments represented in the other figures, as if they were fully illustrated in those figures. Unless otherwise indicated, the drawings are not necessarily to scale. Any dimensions provided on the drawings are not intended to be limiting as to the scope of the invention but merely illustrative.

According to various embodiments of the invention, a new and effective keyboard click noise reduction scheme is presented. The keyboard click noise reduction scheme may have various processing units including: Dynamic Signal Modeler, Smart Model Selector, Adaptive Filtering Module, Keyboard/Impulse Noise and Voice Activity Detectors, and a Post-Processing Unit. By adaptively changing the coefficients of the proposed adaptive filter through minimizing the output energy, the scheme can provide the target signal/voice with nearly zero keyboard click noise. The scheme could be used in real-time to minimize keyboard click noise or any kind of unwanted noise, especially noise having transient impulse characteristics.

General Overview

Figure 1:
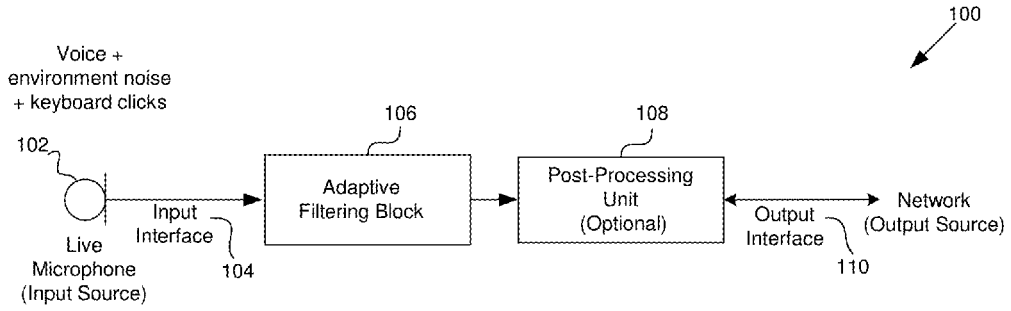
FIG. 1 is a schematic block diagram illustrating an overall design of an unwanted/targeted noise/feature filter (e.g., Key Click Filter or Impulse Noise Filter) according to various embodiments of the present invention.

FIG. 1 is a schematic block diagram illustrating an overall design of an unwanted/targeted noise/feature filter 100 (e.g., Key Click Filter, Impulse Noise Filter, etc.) according to various embodiments of the present invention. In general, filter 100 includes an input interface 104, an adaptive filtering block 106, a post-processing unit 108, and an output interface 110. Input interface 104 is configured to receive an input from an input source 102 (e.g., microphone, recorder, network, etc.) for processing by adaptive filtering block 106. Adaptive filtering block 106 is configured to generate an output based on adaptively minimizing unwanted/targeted noise/feature from the input. The output can be conditioned by optional post-processing unit 108, which is configured to enhance any aspect (e.g., voice quality) of the output. The output or post-processed output is transmitted to an output source (e.g., speakers, recorder, network, etc.) via output interface 110. Accordingly, filter 100 can be implemented such that the unwanted/targeted noise/feature is continually minimized or completely eliminated from the input in real-time while generating the output.

For illustration purposes, filtering of keyboard click noise will be discussed throughout the description although embodiments of the present invention may be applied to the filtering of any unwanted noises (e.g., transient noise, persistent noise, intrinsic noise, extrinsic noise, steady level noise, varying level noise, etc.).

Figure 2:
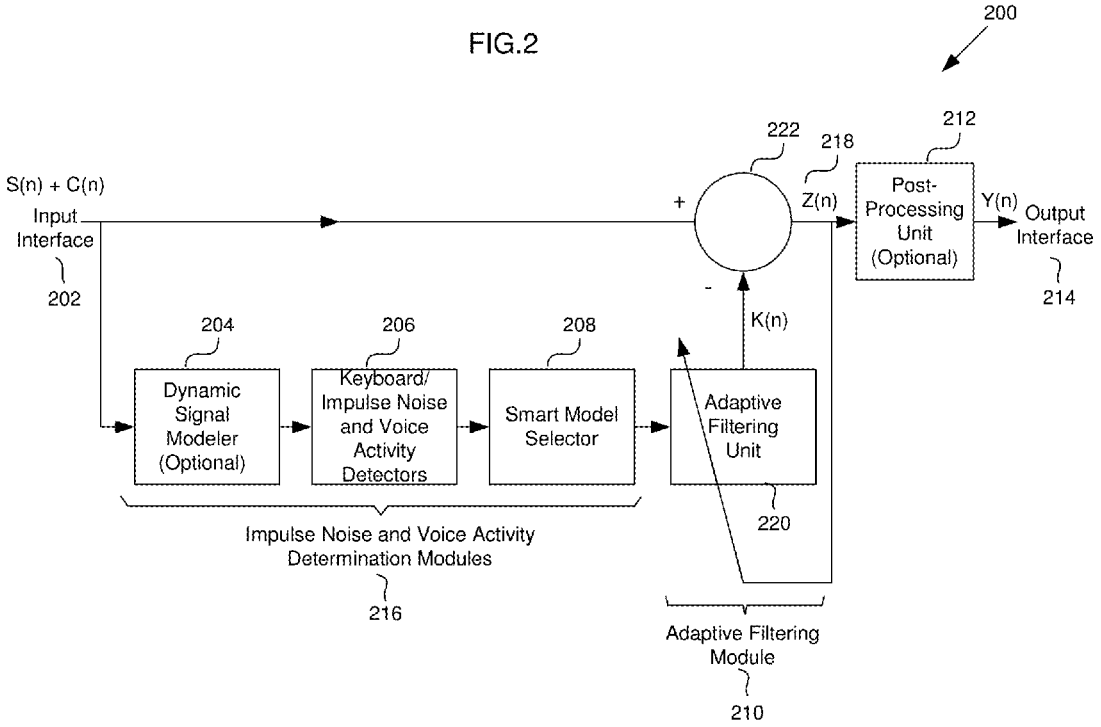
FIG. 2 is a schematic block diagram illustrating a device for minimizing keyboard click noise.

FIG. 2 is a schematic block diagram illustrating a device 200 for minimizing keyboard click noise. FIG. 2 expands on the individual components of the unwanted/targeted noise/feature filter 100 in FIG. 1. As shown in the schematic block diagram, the scheme may include the following units, namely: Input Interface 202, Dynamic Signal Modeler (DSM) 204, Keyboard/Impulse Noise and Voice Activity Detectors 206, Smart Model Selector (SMS) 208, Adaptive Filtering Module 210 (e.g., adaptive filtering unit 220 and adder 222), Post-Processing Unit 212, and Output Interface 214.

According to a preferred embodiment, the DSM unit 204 first receives the output (S(n)+C(n)) from the microphone via input interface 202, which is the targeted signal (S(n)) plus the keyboard click noise (C(n)), and then applies the Keyboard/Voice Activity Detector 206 to identify the input as one of M models that are dynamically determined from the input signals. Keyboard/Voice Activity Detector 206 is configured to determine which duration is noise-only so as to enable DSM 204 and provide a perfect-matched modeling for the Smart Model Selector 208.

The output of DSM 204 gives an indication signal to the Smart Model Selector (SMS) 208 which will select/output the best matching noise signal. In other words, the output of the SMS 208 is free from targeted signal/voice, that is, a suitable representation of the keyboard click noise only. The output of the SMS 208 is fed to an adaptive filtering unit 220 whose output (K(n)) will approximate as closely as possible the noise part in the output of the microphone by adaptively changing the filter coefficients through minimizing the energy of output Z(n), which is the difference via adder 222 of the output of the microphone and the output of the adaptive filtering unit 220. The post-processing unit 212 is an optional unit and can be used to further process the output so as to enhance the output (e.g., voice quality).

Although a single microphone may be used, the scheme could be easily generalized to a multiple microphones case or integrated with a related beam-forming scheme. There are two main multiple microphone variants. The first variant utilizes multiple microphones spaced 4-8" apart with a goal to create a beam in which the ambient noise is suppressed (beam-forming). In this case, the output signal of the beam-forming algorithm can be used as the S(n)+C(n) input signal for the Key Click filter (e.g., 100, 200). Since this input signal is not a good estimate of the Click Signal C(n), the Key Click filter can be used to generate a better estimate of the Click Signal C(n) from the S(n)+C(n) signal it receives. The second variant utilizes multiple microphones of which one of the microphones is close to the source (e.g., keyboard) that generates the Click Signal C(n). In this case, a good estimate of the Click Signal C(n) from the external microphone is achieved and can be used for the adaptive filtering unit/module 210.

In comparing with conventional schemes, the novelties and advantages of this scheme can be summarized as follows:

1) There is minimal or substantially no cancellation of the targeted signal/voice. Since the output of the adaptive filter is a noise-only signal and the targeted voice/signal is not correlated to the noise, minimizing the energy of Z(n) 218 means minimizing the energy of the noise part: [C(n)−K(n)] in the output Z(n). In the ideal case, [C(n)−K(n)] equals to zero and the output Z(n) equals to S(n).

2) There are minimal or substantially no artifacts incurred by this processing. This is because all the processing can be made in the time-domain by sample-by-sample case and there is no assumption about frequency-band between the targeted signal and noise. In other words, there is no frequency-domain processing involvement and minimal or substantially no possibility to cancel the targeted signal whose frequency band is the same as that of the noise.

3) The scheme could be easily generalized to a multiple microphones case or integrated with a related beam-forming scheme where either the DSM unit 204 gets the input directly from the processing output of the microphone array or the adaptive filtering unit 210 gets the input if the microphone array could provide a reference signal which is free of the targeted signal/voice.

Figure 3:
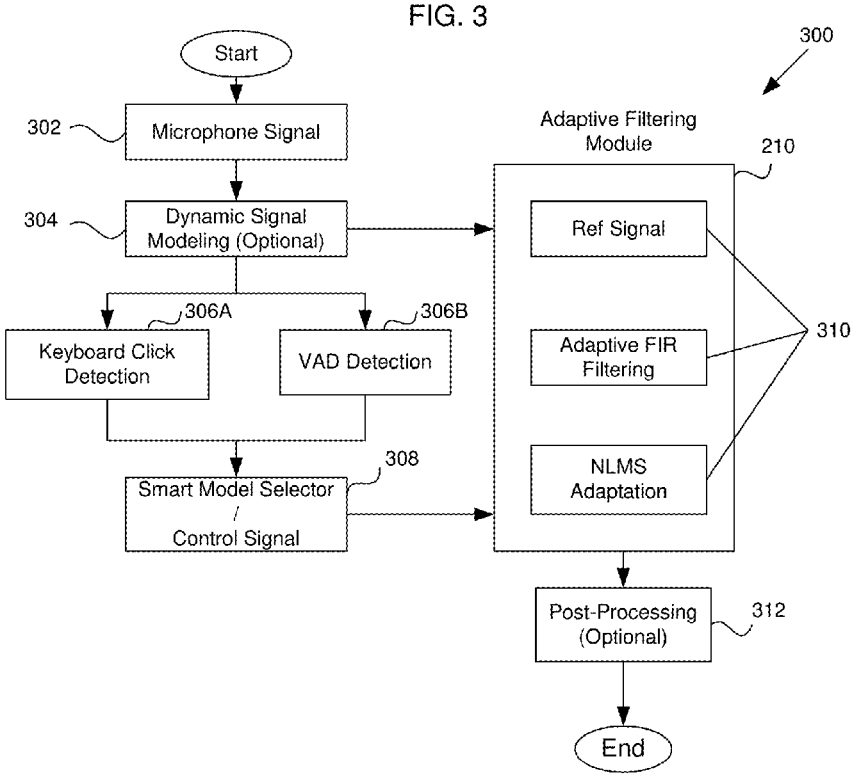
FIG. 3 is a schematic block diagram illustrating a device for minimizing noise.

FIG. 3 is a schematic block diagram 300 illustrating a device for minimizing noise. According to a preferred embodiment, the device is an impulse noise filter (e.g., 100, 200) for minimizing impulse noise in a communication session. The impulse noise filter may include an input interface 202 operable to receive an audio input 302 from an audio source; an impulse noise determination module 216 operable to determine whether the audio input includes impulse noise; a voice activity determination module 216 operable to determine whether the audio input includes voice; and an adaptive filtering module 210 operable to generate an audio output by adaptively filtering the audio input based on the determination of impulse noise being included in the audio input and based on the determination of voice being included in the audio input. The adaptive filtering minimizes the impulse noise and maximizes the voice in the audio input.

Impulse noise determination module 216 and the voice activity determination module 216 may include a dynamic signal modeler 204, an impulse noise detector 206, a voice activity detector 206, and a smart model selector 208. Dynamic signal modeler 204 is operable to apply dynamic signal modeling 304 to audio input 302 in modeling the audio input for impulse noise and voice. Dynamic signal modeling 304 can be a linear prediction analysis, spectral whitening processing, or other technique particular to the desired application. Impulse noise detector 206 is operable to apply an impulse noise detection 306A to audio input 302 in identifying the impulse noise in the audio input. Impulse noise detection 306A can be a noisy excitation analysis, power estimation analysis, or other technique particular to the desired application. Voice activity detector 206 is operable to apply a voice activity detection 306B to audio input 302 in identifying the voice in the audio input. Voice activity detection 306B can be based on at least one of zero-crossing rate and energy ratio between low band and full band, noisy excitation analysis, power estimation analysis, or other technique particular to the desired application. Smart model selector 208 is operable to determine an impulse noise match between the identified impulse noise and an impulse noise sample from a database of impulse noise samples. The smart model selector is also operable to compare a power estimation of the identified voice to a predetermined power estimation range for voice.

Accordingly, the audio input includes impulse noise if there is an impulse noise match; the audio input does not include impulse noise if there is no impulse noise match; the audio input includes voice if the power estimation is within the predetermined power estimation range; and the audio input does not include voice if the power estimation is outside the predetermined power estimation range.

According to various embodiments of the present invention, the smart model selector is further operable to determine a reference signal for the impulse noise, determine an adaptation rate for adaptively filtering the audio input, and provide the adaptation rate and reference signal to the adaptive filtering unit/module. Where the input interface is further operable to receive a second audio input from a second audio source and where the determination of impulse noise being included in the audio input includes an identification of the impulse noise, the smart model selector is further operable to either: select the reference signal from the identified impulse noise; select the reference signal from a predefined database of impulse noises; or select the reference signal from the second audio input from the second audio source, the second audio input including substantially the impulse noise. Smart model selector is operable to generate corresponding control signals to interface with various components (e.g., adaptive filtering module 210) of the impulse noise filter.

Adaptive filtering module 210 is operable to generate an audio output by adaptively filtering the audio input based on the control signals 308 from smart model selector 208 or from within adaptive filtering module 210. The control signals may indicate the selected reference signal, the determined adaptation rate, the adaptation of normalized least mean square, or any other parameter/process 310 for adaptively filtering the audio input such that the impulse noise is minimized and the voice is maximized in the audio output. The audio output can be optionally conditioned via a post processing unit 212. For example, post processing unit 212 can be operable to apply post-processing 312 (e.g., smoothing) to the audio output.

It will be appreciated by those skilled in the art that the present invention is applicable to any type of session where signal filtering is performed. For example, the session could be a recording session.

Keyboard Click Detection

Figure 4:
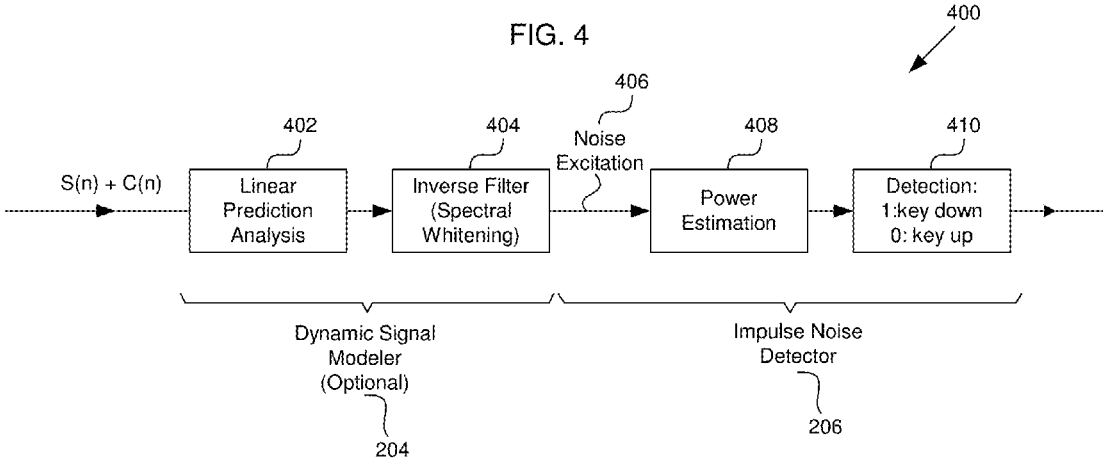
FIG. 4 is a schematic block diagram illustrating a device for keyboard click detection.

FIG. 4 is a schematic block diagram 400 illustrating a device for keyboard click detection. Keyboard click detection may include an optional dynamic signal modeler 204 and a keyboard click detector or impulse noise detector 206. In cases where the keyboard click noise is known, the dynamic signal modeler 204 can be omitted. In cases where the keyboard click noise is not known, the dynamic signal modeler 204 can be included to estimate the keyboard click noise. It will be appreciated by those skilled in the art that the dynamic signal modeler 204 can still be used even if the keyboard click noise is known. In a preferred embodiment, the dynamic signal modeler 204 uses Linear Prediction Analysis 402, which may employ a model of the human voice to determine whether or not someone is speaking and whether or not keys are being depressed at the same time, and/or an inverse filter (spectral whitening) 404.

The keyboard click detector 206 is operable to identify/determine the keyboard click noise (e.g., key-strike and/or key-release). Keyboard click detector 206 may include a noisy excitation analysis 406, power estimation analysis 408, detection identification 410 (e.g., 1=key down, 0=key up), or any other technique suitable for identifying/determining the keyboard click noise. It is appreciated that most keyboard click noise displays impulse signal characteristics and/or wide band whereas voice displays high energy and/or narrow band. In some embodiments, identifying/determining the keyboard click noise includes determining whether the identified keyboard click noise matches a keyboard click noise sample from a database of keyboard click noise samples.

Voice Activity Detection

According to various embodiments, Voice Activity Detection (VAD) is based on the zero-crossing rate, energy ratio between low band and full band, the above linear prediction coefficients and/or the above estimated power. VAD may provide an identification (e.g., 1=voice present, 0=voice absent) of voice in the input signal. Key Click Detection and VAD may be implemented separately or together in a common unit or share common components (e.g., dynamic signal modeler, Power Estimation).

Smart Model Selector (Control Signal Logic)

In order to achieve effective adaptive FIR filtering, a good estimate of the Click signal C(n), also called the reference signal, is needed in some embodiments. The determination of the reference signal can be handled by the Smart Model Selector or a dedicated Ref Signal block. There are a few approaches to obtain the estimation for C(n):

- There is a reference microphone inside the case of the keyboard, the signal picked up by this reference microphone will be the reference signal C(n).
- Estimated from the microphone signal S(n)+C(n) when VAD=0 and keyboard Click Detection detects a "Key Down".
- Mathematical models of the keyboard click noise.
- The pre-stored digital recordings of typical keyboard click noise samples.

Adaptive Filtering

Figure 5:
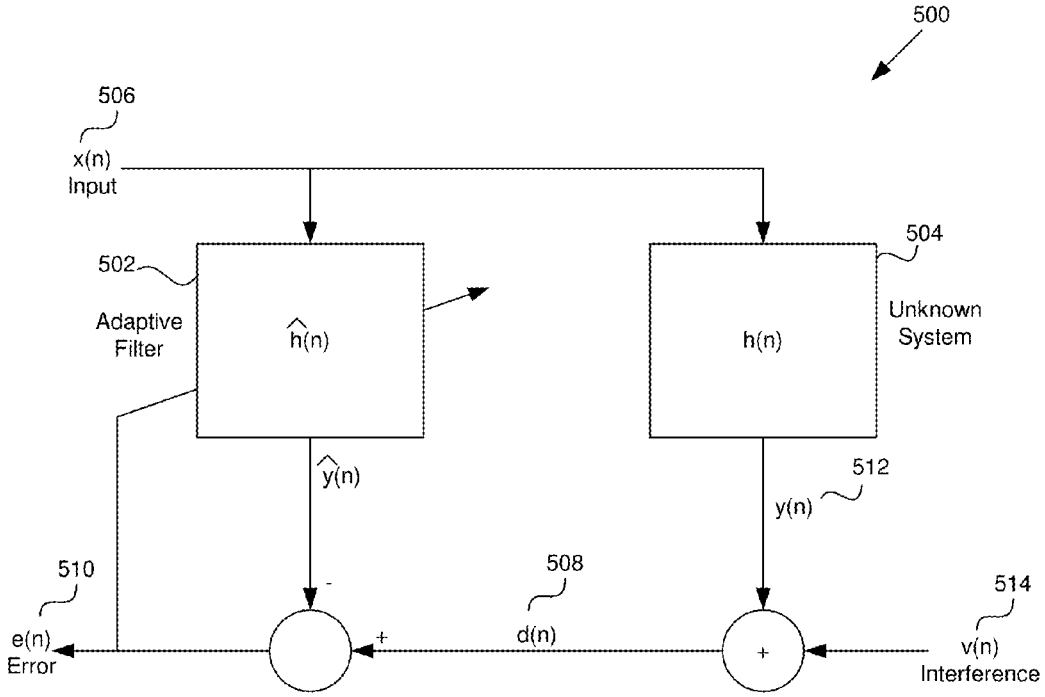
FIG. 5 is a schematic block diagram illustrating an adaptive filter connected to an unknown system.

FIG. 5 is a schematic block diagram 500 illustrating an adaptive filter 502 (e.g. 210) connected to an unknown system 504. Most linear adaptive filtering problems can be formulated using this block diagram. That is, an unknown system h(n) 504 is to be identified and the adaptive filter attempts to adapt the filter $\hat{h}(n)$ 502 to make it as close as possible to h(n) 504 while using only observable signals x(n) 506, d(n) 508 and e(n) 510. Note that y(n) 512, v(n) 514 and h(n) 504 are not directly observable.

Least mean squares (LMS) algorithms are a class of adaptive filter used to mimic a desired filter by finding the filter coefficients that relate to producing the least mean squares of the error signal (difference between the desired and the actual signal). The main drawback of the "pure" LMS algorithm is that it is sensitive to the scaling of its input x(n). This makes it very hard (if not impossible) to choose a learning/adaptation rate μ that guarantees stability of the algorithm.

For the adaptation of the FIR filter, a Normalized least mean square (NLMS) algorithm may be implemented. The Normalized least mean squares filter (NLMS) is a variant of the LMS algorithm that solves the above described LMS problem by normalizing with the power of the input. The NLMS algorithm can be summarized as:

Parameters: p=filter order, μ=step size

Initialization: $\hat{h}(0)=0$

Computation:

$$\text{For } n = 0, 1, 2, \ldots$$

$$x(n) = [x(n), x(n-1), \ldots, x(n-p+1)]^T$$

$$e(n) = d(n) - \hat{h}^H(n)x(n)$$

$$\hat{h}(n+1) = \hat{h}(n) + \frac{\mu e*(n)x(n)}{x^H(n)x(n)}$$

where $\hat{h}^H(n)$ denotes the Hermitian transpose of $\hat{h}(n)$.

Post-Processing

Post-Processing can be optionally implemented to further reduce/minimize the keyboard noise. Either one of the following components, or the combination of them, could be adopted for the post-processing:

1. Adaptive Median Filter

A window of predetermined length slides sequentially over the signal, and the mid-sample within the window is replaced by, under the following conditions, the median of all the samples that are inside the windows:

(a) If the difference between the sample and the median is above the threshold, $$Y(n)=Z(n), \text{ if } |Z(n)-Z_{med}(n)|<k*|Z(n)|$$

$$Y(n)=Z_{med}(n), \text{ otherwise}$$

where k is a tuning parameter.

(b) When VAD=0 and Keyboard Click Detection detects "Key Down".

2. Adaptive Interpolator

Keyboard click noise usually lasts for a very short time. In order to avoid the unnecessary processing and compromise in the quality of the relatively large fraction of samples that are not disturbed by the click noise, it would be good to correct only those samples that are distorted. This correction could be performed by replacing the distorted samples with samples derived from the samples on both sides of the click noise. A high-fidelity interpolator (e.g., the Least Square Autoregressive, LSAR) would be fine for the audio signal processing.

Additional Embodiment Details

Figure 6:
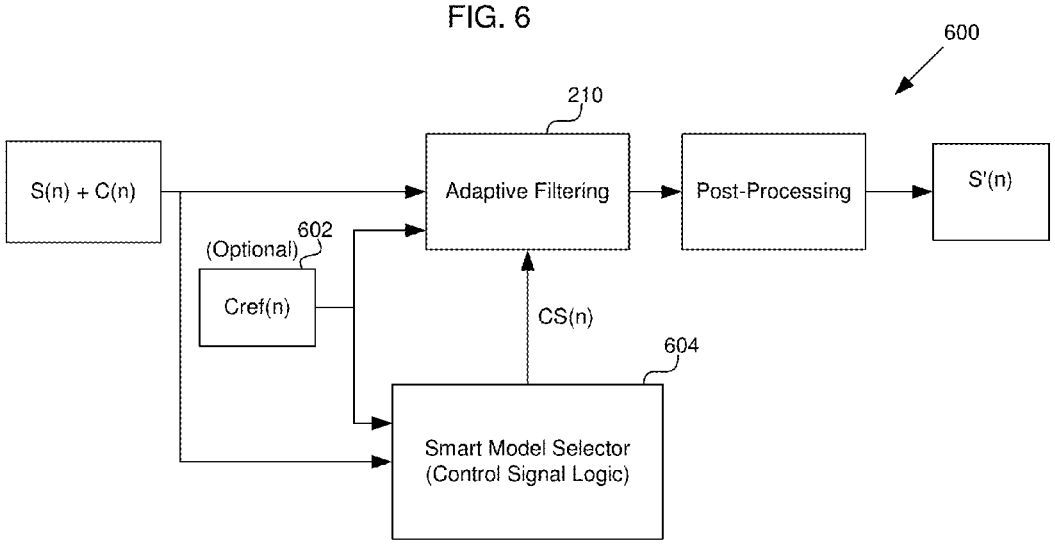
FIG. 6 is a schematic block diagram illustrating an adaptive filter for minimizing keyboard click noise.

FIG. 6 is a schematic block diagram 600 illustrating an adaptive filter 210 for minimizing keyboard click noise. The block diagram 600 illustrates the main signal flow; on the left side is the sum of the desired signal S(n) and the click distortion C(n). The signal Cref(n) 602 is only available if there is a dedicated microphone positioned close to the click distortion source (e.g. the keyboard). The Key Click filter (e.g., 100, 200, 300) can operate with or without the signal Cref(n) 602.

Figure 7:
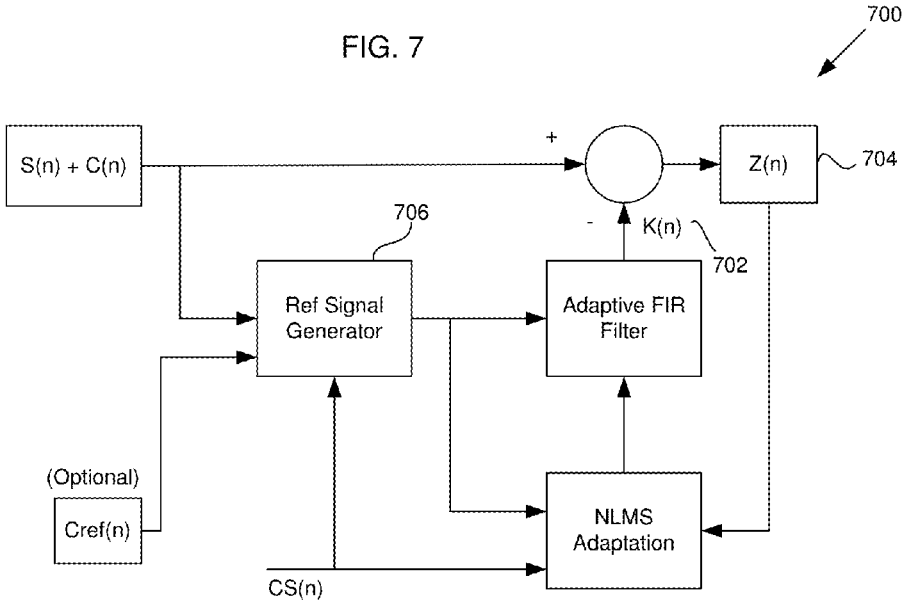
FIG. 7 is a schematic block diagram illustrating an adaptive filter for minimizing keyboard click noise.

FIG. 7 is a schematic block diagram 700 illustrating an adaptive filter (e.g., 210) for minimizing keyboard click noise. The block diagram 700 illustrates a possible signal flow in the Adaptive Filtering Module 210 in FIG. 6. The Ref Signal Generator 706 will determine the reference signal on the basis of either the signal Cref(n) captured from the extra microphone which is close to the key click source, or the click noise estimated from the S(n)+C(n) which is controlled by the control signal CS(n), or the click noise statistic model. The resultant reference signal is processed by the Adaptive FIR Filter. The signal K(n) 702, the output of the adaptive FIR filter, is an estimation of the actual click distortion signal C(n). Subtracting the K(n) 702 from the microphone signal S(n)+C(n), the signal Z(n) 704 which is an intermediate signal that has part of the click signal C(n) attenuated and is the input to the optional Post Processing block (e.g., 108, 212) is obtained. The coefficients of the adaptive FIR filter are automatically updated by the NLMS Adaptation algorithm. The adaptation rate is controlled by the control signal CS(n). When key click is active and there is no voice activity, the adaptation rate is the largest. When key click is not active and there is voice activity, the adaptation rate is zero, i.e., the adaptation is frozen.

Figure 8:
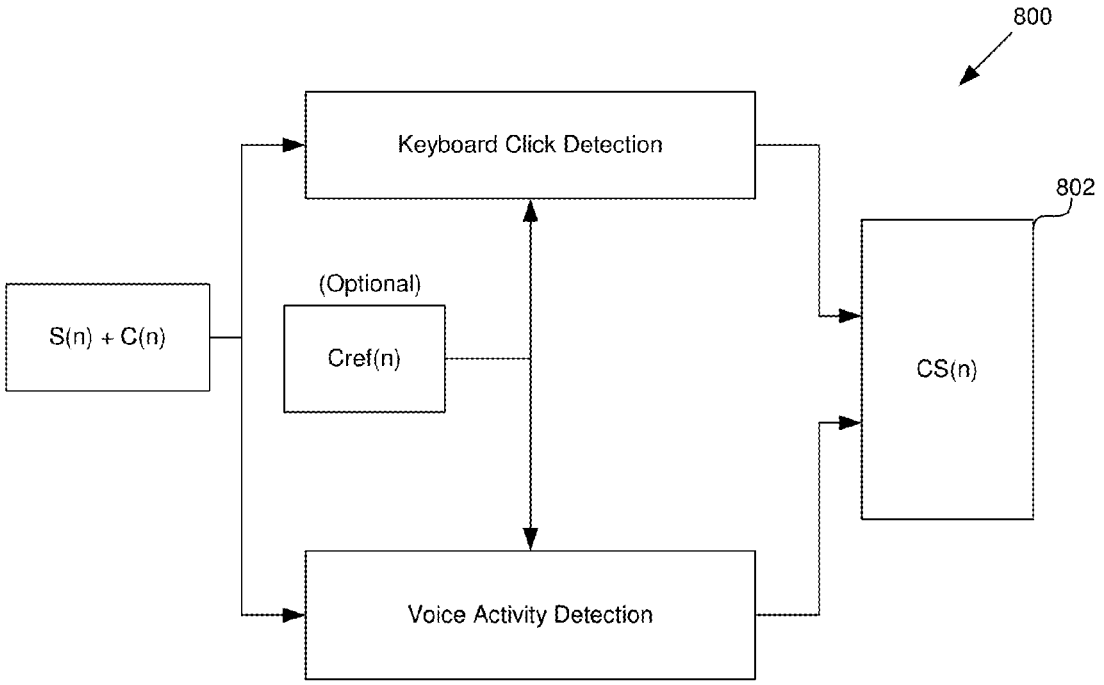
FIG. 8 is a schematic block diagram illustrating a device for control signal logic.

FIG. 8 is a schematic block diagram 800 illustrating a device for control signal logic (e.g., 208, 308). The block diagram shows one possible embodiment of the Control Signal Logic 604 in FIG. 6. The signal CS(n) 802 is not an audio signal, but a control signal (i.e. it is used to alter the behavior of the Ref Signal Generator and the NLMS adaptation blocks).

The Keyboard Click Detection (e.g., 206, 306A) will result in the logic output 0 or 1, the 0 means "key up", i.e., there is no key click noise, the 1 means "key down", i.e., there is key click noise. This info can be employed to estimate the reference signal for the adaptive FIR filter.

The Voice Activity Detection (e.g., 206, 306B) will also result in the logic output 0 or 1. the 0 means that there is no voice activity, the 1 means that there is voice activity.

Therefore, four types of situations can be detected, i.e., Key up and VAD=0; Key up and VAD=1, Key down and VAD=0, Key down and VAD=1. The info of the four combinations can be used to dynamically adjust the adaptation rate.

Figure 9:
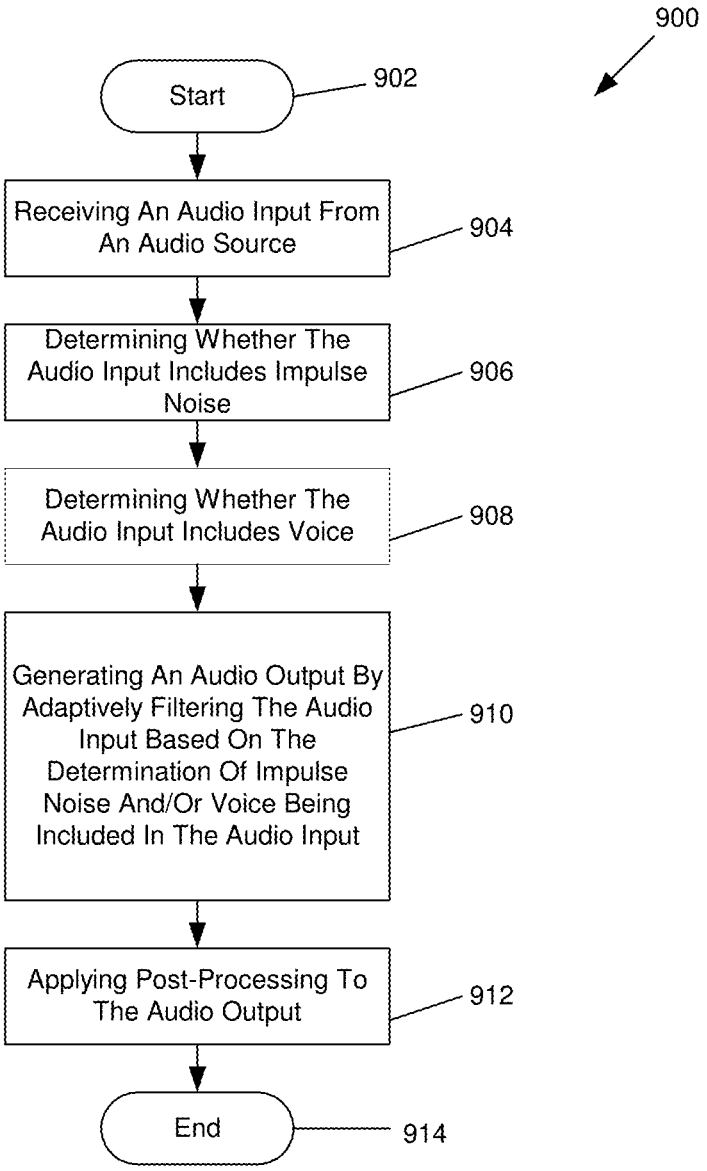
FIG. 9 is a flow diagram for an impulse noise filter to minimize impulse noise in a communication session.

FIG. 9 is a flow diagram 900 for an impulse noise filter to minimize impulse noise in a communication session. The flow begins at step 902 where the process starts; then continues to step 904: receiving an audio input from an audio source; then continues to step 906: determining whether the audio input includes impulse noise; then continues to step 908: determining whether the audio input includes voice; then continues to step 910: generating an audio output by adaptively filtering the audio input based on the determination of impulse noise being included in the audio input and based on the determination of voice being included in the audio input; then continues to optional step 912: applying post-processing to the audio output; and then ends at step 914. The adaptive filtering minimizes the impulse noise and maximizes the voice in the audio input.

Step 906 may include applying an impulse noise detection to the audio input in identifying the impulse noise in the audio input. The impulse noise detection can be noisy excitation analysis, power estimation analysis, or any other technique suitable for the application. Step 906 may also include applying dynamic signal modeling to the audio input in modeling the audio input for impulse noise and determining whether the identified impulse noise matches an impulse noise sample from a database of impulse noise samples. The audio input includes impulse noise if there is a match whereas the audio input does not include impulse noise if there is no match. The dynamic signal modeling can be linear prediction analysis, spectral whitening processing, or any other technique suitable for the application. Furthermore, applying dynamic signal modeling and impulse noise detection to the audio input may include generating a modeled audio input for impulse noise. Yet, applying the impulse noise detection to the audio input may include identifying the impulse noise in the modeled audio input.

Step 908 may include applying a voice activity detection to the audio input in identifying the voice in the audio input. The voice activity detection being based on at least one of zero-crossing rate and energy ratio between low band and full band, noisy excitation analysis, power estimation analysis, and any other technique suitable for the application. Step 908 may also include applying dynamic signal modeling to the audio input in modeling the audio input for voice and comparing a power estimation of the identified voice to a predetermined power estimation range for voice. The audio input includes voice if the power estimation is within the predetermined power estimation range whereas the audio input does not include voice if the power estimation is outside the predetermined power estimation range. The dynamic signal modeling can be linear prediction analysis, spectral whitening processing, or any other technique suitable for the application. Furthermore, applying dynamic signal modeling and voice activity detection to the audio input may include generating a modeled audio input for voice and a modeled audio input for pitch. Yet, applying the voice activity detection to the audio input may include identifying the voice in the modeled audio input based on the modeled audio input for pitch.

Step 910 may include using a minimum adaptation rate for adaptively filtering the audio input if impulse noise is not included; using a maximum adaptation rate for adaptively filtering the audio input if impulse noise is included and voice is not included; and using an adaptation rate between the minimum and maximum adaptation rates for adaptively filtering the audio input if impulse noise is included and voice is included. Step 910 may also include receiving a reference signal for the impulse noise; applying the reference signal to an adaptive filter; generating an output of the adaptive filter; and applying the output of the adaptive filter to the audio input in generating the audio output.

The reference signal for the impulse noise can be determined by selecting the reference signal from an identified impulse noise in the audio input; selecting the reference signal from a predefined database of impulse noises; or selecting the reference signal from a second audio input from a second audio source, which the second audio input includes substantially the impulse noise. The first and second audio sources can be a microphone, an audio recording, or an audio stream. The adaptive filter may implement a normalized least mean squares algorithm. The communication session can be a live communication session.

Step 912 may include processing with an adaptive median filter, an adaptive interpolator, or any other technique suitable for the application.

The impulse noise can be based on non-vocal sounds. In a preferred embodiment, the impulse noise has a sharp transient wave signal characteristic. The non-vocal sounds can be hitting/typing a keyboard sound, closing a door sound, dropping a book sound, hammering a fastener sound, and instrumental sound. Although the present invention is applicable to filtering impulse noise, it will be appreciated by those skilled in the art that the filter can be designed to filter out any signal feature in real-time.

Figure 10:
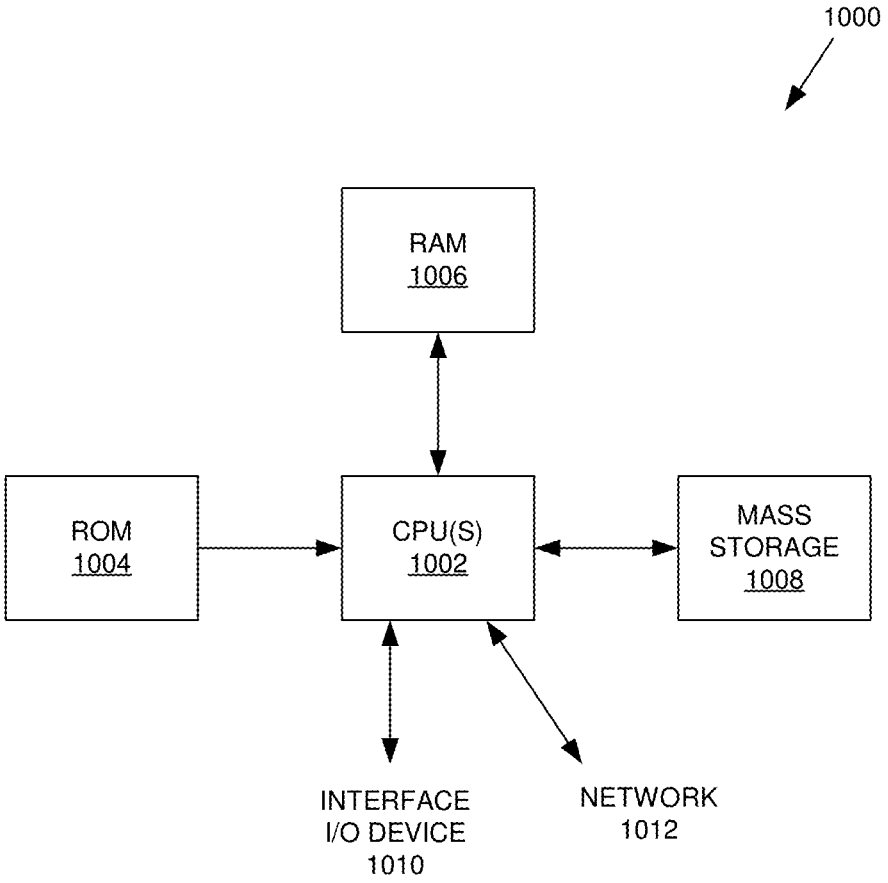
FIG. 10 illustrates a typical computer system that can be used in connection with one or more embodiments of the present invention.

This invention also relates to using a computer system according to one or more embodiments of the present invention. FIG. 10 illustrates a typical computer system 1000 that can be used in connection with one or more embodiments of the present invention. The computer system 1000 includes one or more processors 1002 (also referred to as central processing units, or CPUs) that are coupled to storage devices including primary storage 1006 (typically a random access memory, or RAM) and another primary storage 1004 (typically a read only memory, or ROM). As is well known in the art, primary storage 1004 acts to transfer data and instructions uni-directionally to the CPU and primary storage 1006 is used typically to transfer data and instructions in a bi-directional manner. Both of these primary storage devices may include any suitable computer-readable media, including a computer program product comprising a machine readable medium on which is provided program instructions according to one or more embodiments of the present invention.

A mass storage device 1008 also is coupled bi-directionally to CPU 1002 and provides additional data storage capacity and may include any of the computer-readable media, including a computer program product comprising a machine readable medium on which is provided program instructions according to one or more embodiments of the present invention. The mass storage device 1008 may be used to store programs, data and the like and is typically a secondary storage medium such as a hard disk that is slower than primary storage. It will be appreciated that the information retained within the mass storage device 1008, may, in appropriate cases, be incorporated in standard fashion as part of primary storage 1006 as virtual memory. A specific mass storage device such as a CD-ROM may also pass data uni-directionally to the CPU.

CPU 1002 also is coupled to an interface 1010 that includes one or more input/output devices such as such as video monitors, track balls, mice, keyboards, microphones, touch-sensitive displays, transducer card readers, magnetic or paper tape readers, tablets, styluses, voice or handwriting recognizers, or other well-known input devices such as, of course, other computers. Finally, CPU 1002 optionally may be coupled to a computer or telecommunications network using a network connection as shown generally at 1012. With such a network connection, it is contemplated that the CPU might receive information from the network, or might output information to the network in the course of performing the above-described method steps. The above-described devices and materials will be familiar to those of skill in the computer hardware and software arts.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A method for an impulse noise filter to minimize impulse noise in a communication session, comprising:

receiving an audio input from an audio source;

determining whether the audio input includes impulse noise;

determining whether the audio input includes voice; and generating an audio output by adaptively filtering the audio input based on the determination of impulse noise being included in the audio input and based on the determination of voice being included in the audio input, wherein the adaptive filtering minimizes the impulse noise and maximizes the voice in the audio input, wherein determining whether the audio input includes impulse noise comprises:

applying an impulse noise detection to the audio input in identifying the impulse noise in the audio input, the impulse noise detection being selected from the group consisting of noisy excitation analysis and power estimation analysis; and determining whether the identified impulse noise matches an impulse noise sample from a database of impulse noise samples, wherein the audio input includes impulse noise if there is a match, and wherein the audio input does not include impulse noise if there is no match.

2. The method as recited in claim 1, wherein determining whether the audio input includes impulse noise comprises:

applying dynamic signal modeling to the audio input in modeling the audio input for impulse noise, the dynamic signal modeling being selected from the group consisting of linear prediction analysis and spectral whitening processing.

3. The method as recited in claim 2, wherein applying dynamic signal modeling and impulse noise detection to the audio input comprises generating a modeled audio input for impulse noise; and wherein applying the impulse noise detection to the audio input comprises identifying the impulse noise in the modeled audio input.

4. The method as recited in claim 1, wherein determining whether the audio input includes voice comprises:

applying a voice activity detection to the audio input in identifying the voice in the audio input, the voice activity detection being based on at least one of zero-crossing rate and energy ratio between low band and full band, noisy excitation analysis and power estimation analysis.

5. The method as recited in claim 4, wherein determining whether the audio input includes voice comprises:

applying dynamic signal modeling to the audio input in modeling the audio input for voice, the dynamic signal modeling being selected from the group consisting of linear prediction analysis and spectral whitening processing; and comparing a power estimation of the identified voice to a predetermined power estimation range for voice, wherein the audio input includes voice if the power estimation is within the predetermined power estimation range; and wherein the audio input does not include voice if the power estimation is outside the predetermined power estimation range.

6. The method as recited in claim 5, wherein applying dynamic signal modeling and voice activity detection to the audio input comprises generating a modeled audio input for voice and a modeled audio input for pitch; and wherein applying the voice activity detection to the audio input comprises identifying the voice in the modeled audio input based on the modeled audio input for pitch.

7. The method as recited in claim 1, wherein generating the audio output by adaptively filtering the audio input based on the determination of impulse noise being included in the audio input and based on the determination of voice being included in the audio input comprises:

receiving a reference signal for the impulse noise;

applying the reference signal to an adaptive filter;

generating an output of the adaptive filter; and applying the output of the adaptive filter to the audio input in generating the audio output.

8. The method as recited in claim 7, wherein the reference signal for the impulse noise is determined by selecting the reference signal from an identified impulse noise in the audio input.

9. The method as recited in claim 7, wherein the reference signal for the impulse noise is determined by selecting the reference signal from a predefined database of impulse noises.

10. The method as recited in claim 7, wherein the reference signal for the impulse noise is determined by selecting the reference signal from a second audio input from a second audio source, the second audio input including substantially the impulse noise.

11. The method as recited in claim 10, wherein the first and second audio sources are selected from the group consisting of: a microphone, an audio recording, and an audio stream.

12. The method as recited in claim 7, wherein the adaptive filter uses a normalized least mean squares algorithm.

13. The method as recited in claim 12, wherein the communication session is a live communication session.

14. The method as recited in claim 1, further comprising:

applying post-processing to the audio output, wherein the post-processing is selected from the group consisting of an adaptive median filter and an adaptive interpolator.

15. The method as recited in claim 1, wherein the impulse noise is based on non-vocal sounds, the impulse noise having a sharp transient wave signal characteristic.

16. The method as recited in claim 15, wherein the non-vocal sounds is selected from the group consisting of: hitting a keyboard sound, closing a door sound, dropping a book sound, hammering a fastener sound, and instrumental sound.

17. A method for an impulse noise filter to minimize impulse noise in a communication session, comprising:

receiving an audio input from an audio source;

determining whether the audio input includes impulse noise;

determining whether the audio input includes voice; and generating an audio output by adaptively filtering the audio input based on the determination of impulse noise being included in the audio input and based on the determination of voice being included in the audio input, wherein the adaptive filtering minimizes the impulse noise and maximizes the voice in the audio input, wherein generating the audio output by adaptively filtering the audio input based on the determination of impulse noise being included in the audio input and based on the determination of voice being included in the audio input comprises:

if impulse noise is not included, using a minimum adaptation rate for adaptively filtering the audio input;

if impulse noise is included and voice is not included, using a maximum adaptation rate for adaptively filtering the audio input; and if impulse noise is included and voice is included, using an adaptation rate between the minimum and maximum adaptation rates for adaptively filtering the audio input.

18. An impulse noise filter for minimizing impulse noise in a communication session, comprising:

an input interface operable to receive an audio input from an audio source;

an impulse noise determination module operable to determine whether the audio input includes impulse noise;

a voice activity determination module operable to determine whether the audio input includes voice; and an adaptive filtering module operable to generate an audio output by adaptively filtering the audio input based on the determination of impulse noise being included in the audio input and based on the determination of voice being included in the audio input, wherein the adaptive filtering minimizes the impulse noise and maximizes the voice in the audio input, wherein the impulse noise determination module and the voice activity determination module comprise:

an impulse noise detector operable to apply an impulse noise detection to the audio input in identifying the impulse noise in the audio input, the impulse noise detection being selected from the group consisting of noisy excitation analysis and power estimation analysis; and a smart model selector operable to determine an impulse noise match between the identified impulse noise and an impulse noise sample from a database of impulse noise samples, wherein the audio input includes impulse noise if there is an impulse noise match, and wherein the audio input does not include impulse noise if there is no impulse noise match.

19. The impulse noise filter as recited in claim 18, wherein the impulse noise determination module and the voice activity determination module further comprise:

a dynamic signal modeler operable to apply dynamic signal modeling to the audio input in modeling the audio input for impulse noise and voice, the dynamic signal modeling being selected from the group consisting of linear prediction analysis and spectral whitening processing; and an voice activity detector operable to apply a voice activity detection to the audio input in identifying the voice in the audio input, the voice activity detection being based on at least one of zero-crossing rate and energy ratio between low band and full band, noisy excitation analysis and power estimation analysis, wherein the smart model selector is further operable to compare a power estimation of the identified voice to a predetermined power estimation range for voice, wherein the audio input includes voice if the power estimation is within the predetermined power estimation range, and wherein the audio input does not include voice if the power estimation is outside the predetermined power estimation range.

20. The impulse noise filter as recited in claim 19, wherein the smart model selector is further operable to determine a reference signal for the impulse noise, determine an adaptation rate for adaptively filtering the audio input, and provide the adaptation rate and reference signal to the adaptive filter.

21. The impulse noise filter as recited in claim 20, wherein the input interface is further operable to receive a second audio input from a second audio source, wherein the determination of impulse noise being included in the audio input comprises an identification of the impulse noise, and wherein the smart model selector is further operable to either:

select the reference signal from the identified impulse noise;

select the reference signal from a predefined database of impulse noises; or select the reference signal from the second audio input from the second audio source, the second audio input including substantially the impulse noise.

22. A computer program product for minimizing impulse noise in a communication session, the computer program product being embodied in a non-transitory computer readable medium and comprising computer executable instructions for:

receiving an audio input from an audio source;

determining whether the audio input includes impulse noise;

determining whether the audio input includes voice; and generating an audio output by adaptively filtering the audio input based on the determination of impulse noise being included in the audio input and based on the determination of voice being included in the audio input, wherein the adaptive filtering minimizes the impulse noise and maximizes the voice in the audio input, wherein determining whether the audio input includes impulse noise comprises:

applying an impulse noise detection to the audio input in identifying the impulse noise in the audio input, the impulse noise detection being selected from the group consisting of noisy excitation analysis and power estimation analysis; and determining whether the identified impulse noise matches an impulse noise sample from a database of impulse noise samples, wherein the audio input includes impulse noise if there is a match, and wherein the audio input does not include impulse noise if there is no match.

* * * * *